US009540955B2

(12) United States Patent
Ring

(10) Patent No.: US 9,540,955 B2
(45) Date of Patent: Jan. 10, 2017

(54) STATOR ASSEMBLY

(75) Inventor: Mark David Ring, Cape Neddick, ME (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 1012 days.

(21) Appl. No.: 13/467,201

(22) Filed: May 9, 2012

(65) Prior Publication Data

US 2013/0302151 A1 Nov. 14, 2013

(51) Int. Cl.
*F01D 25/24* (2006.01)

(52) U.S. Cl.
CPC ..... *F01D 25/246* (2013.01)

(58) Field of Classification Search
CPC ..... F01D 9/04
USPC ..... 415/209.2, 209.3
See application file for complete search history.

(56) References Cited

U.S. PATENT DOCUMENTS 5,584,654 A 12/1996 Schaefer et al.
5,918,461 A 7/1999 Bacon
6,062,813 A * 5/2000 Halliwell et al. ..... 415/174.5
7,032,904 B2 4/2006 Rogers
7,258,525 B2 * 8/2007 Boeck ..... 415/209.3
2004/0067131 A1 4/2004 Joslin
2005/0111969 A1 5/2005 Arness et al.
2006/0153683 A1 7/2006 Dube et al.
2012/0051930 A1 3/2012 Pandey et al.

OTHER PUBLICATIONS

International Search Report and Written Opinion for related International Application No. PCT/US13/36747; report dated Aug. 2, 2013.

* cited by examiner

*Primary Examiner* — Craig Kim
*Assistant Examiner* — Michael Sehn
(74) *Attorney, Agent, or Firm* — Cantor Colburn LLP

(57) ABSTRACT

A stator assembly or a stator stage is disclosed. The stator assembly includes an endless case that is coupled to or includes at least one lug for engaging an anti-rotation stator segment. The anti-rotator segment includes one curved side edge and one straight or linear side edge. The case also accommodates a plurality of middle stator segments, each having curved side edges on both sides. Finally, a third type of stator segment is a "neighbor" stator segment with one curved side edge and one linear side edge that abuttingly engages the linear side edge of the anti-rotation stator segment. The straight or linear side edges of the anti-rotation stator segments and the neighbor stator segments enable an endless case to be loaded with stator segments from an axial direction. None of the stator segments need to be installed from a radial direction.

18 Claims, 3 Drawing Sheets

STATOR ASSEMBLY

TECHNICAL FIELD

A gas turbine engine is disclosed with stator segments that are prevented from circumferentially rotating about the axis of the engine and/or along the case that holds the stator segments in place. More specifically, an anti-rotation stator segment and adjacent stator segment are disclosed that facilitate the assembly of an endless ring of stator segments or an endless ring of stator segment clusters.

BACKGROUND

A gas turbine engine includes one or more forward compressor sections for increasing the pressure of an incoming air stream. For example, a turbofan jet engine includes a low pressure compressor (LPC) disposed between fan at the inlet of the engine and a high pressure compressor (HPC). Each compressor includes alternating axial stages of rotors and stators. Each stator is disposed within a circumferential case. Each rotor may include an outer ring of rotating blades; each stator may include a ring of stator segments, with each segment including a shroud connected to an individual vane or a shroud connected to a plurality of vanes. Each shroud may include forward and aft hooks for coupling the segment to the case. More specifically, each shroud may include a forward hook that is received in a forward slot of the case. Further, each shroud may include an aft hook that is received in an aft slot of the case or a pair of aft hooks that receive a forwardly extending tab of the case.

The case may be split into forward and aft portions. For example, during assembly, each segment is inserted axially into the case by inserting the aft hook(s) of each segment into the aft slot of the aft case portion. Then, when all of the segments are installed in the aft case portion, the forward portion of the case may be axially installed by inserting the forward hooks of the stator segments into the slot of the forward portion of the case.

One problem associated with the above-described stators is the potential for axial movement of the individual stator segments within the case when a load is imposed upon the stator assembly. See, e.g., U.S. Pat. No. 7,032,904. One way to avoid axial movement of the individual stator segments is to provide non-linear or non-straight side edges of the shrouds of the individual stator segments. The side edges may be shaped so that adjacent side edges of stator vane segments will fit together in a complementary manner. However, using non-linear side edges for the shrouds of the individual stator segments creates problems when axially inserting the individual stator segments into the case. Specifically, the last vane segment of each stator to be placed in the case may only be installed radially, not axially, due to interference with the side edges of the remaining stator segments. This is problematic because of the use of the forward and aft hooks to secure the stators to the case.

As a result, there is a need for an improved stator segment design that enables all stator segments to be inserted into an endless case axially as opposed to radially and in an efficient manner.

SUMMARY OF THE DISCLOSURE

An improved stator assembly is disclosed. The disclosed stator assembly includes an endless case coupled to a lug and which defines an axis. The case is also coupled to a plurality of stator segments for forming an endless ring of stator segments. Each stator segment includes a shroud coupled to the case and a radially inwardly extending vane. The shroud of each stator segment includes first and second opposing side edges. Each of the side edges engages an adjacent stator segment. The plurality of stator segments includes three types. First, an anti-rotation stator segment is provided that is coupled to the lug. Second, a neighbor stator segment is disposed adjacent to the anti-rotation stator segment. Finally, the plurality of stator segments includes a plurality of middle stator segments.

The first side edges of the middle stator segments are non-linear and the second side edges of the middle stator segments are also non-linear and are shaped for abuttingly engaging the first side edge of an adjacent middle stator segment. The first side edge of the anti-rotation stator segment is linear. Further, the second side edge of the neighbor stator segment is also linear for abuttingly engaging the linear first side edge of the anti-rotation stator segment. The second side edge of the anti-rotation stator segment is non-linear and shaped to abuttingly engage a first side edge of an adjacent middle stator segment. The first side of the neighbor stator segment is non-linear and is shaped to abuttingly engage a second side edge of an adjacent middle stator segment.

An improved gas turbine engine is also disclosed. The engine includes an outer shroud and a stator assembly coupled to the outer shroud. The stator assembly includes an endless case coupled to a lug and which defines an axis. The case is coupled to a plurality of stator segments for forming an endless ring of stator segments. Each stator segment includes a shroud coupled to the case and a radially inwardly extending vane. The shroud of each stator segment includes first and second opposing side edges. Each of the side edges engage an adjacent stator segment. The plurality of stator segments also includes an anti-rotation stator segment that is coupled to a lug, a neighbor stator segment disposed adjacent to the anti-rotation stator segment and a plurality of middle stator segments disposed therebetween. The first side edges of the middle stator segments are non-linear as are the second side edges of the middle stator segments. The second side edges of the middle stator segments are shaped for abuttingly engaging the first side edge of an adjacent middle stator segment in a complementary manner. The first side edge of the anti-rotation stator segment is linear. The second side edge of the neighbor stator segment is also linear for abuttingly engaging the first side edge of the anti-rotation stator segment. The second side edge of the anti-rotation stator segment is non-linear and shaped to abuttingly engage a first side edge of an adjacent middle stator segment while the first side edge of the neighbor stator segment is non-linear and shaped to abuttingly engage a second side edge of an adjacent middle stator segment.

A method for forming a stator stage of a gas turbine engine is also disclosed. The method includes providing an endless case coupled to a plurality of lugs and defining an axis. The case includes forward and aft portions that extend towards each other to form forward and aft pockets respectively. The method includes coupling the forward or aft portion of the endless case to an outer shroud of the engine. The method further includes providing a plurality of stator segment clusters. Each stator segment cluster includes an anti-rotation stator segment, a neighbor stator segment and a plurality of middle stator segments disposed therebetween. Each anti-rotation stator segment, neighbor stator segment and middle stator segment includes a shroud and a radially inwardly extending vane. The shroud of each anti-rotation stator segment, neighbor stator segment and middle stator segment includes first and second opposing side edges for engaging an adjacent stator vane segment. The first and second side edges of the middle stator segments are non-linear but are shaped for abuttingly engaging each other when inserted into the case in a side-by-side fashion. The first side edges of the anti-rotation stator segments are linear as are the second side edges of the neighbor stator segments for abuttingly engaging the first side edge of one of the anti-rotation stator segments. The second edges of the anti-rotation stator segments are non-linear and shaped to abuttingly engage the first edge of an adjacent middle stator segment the first side edges of the neighbor stator segments are non-linear and shaped to abuttingly engage the second side edge of an adjacent middle stator segment.

The method further includes axially inserting the anti-rotation stator segment of one cluster into the case at one of the lugs to couple the anti-rotation stator segment to the lug. The method further includes axially placing a middle stator segment next to the anti-rotation stator segment so the first edge of the middle stator segment abuttingly engages the second side edge of the anti-rotation stator segment. The method then further includes repeatedly and axially placing middle stator segments into the case so that the first side edge of a succeeding middle stator segment engages the second side edge of a preceding middle stator segment until a gap exists between a succeeding middle stator segment and a succeeding lug. The method then includes axially inserting the neighbor stator segment into the gap and axially inserting another anti-rotation stator segment into the case to couple the anti-rotation stator segment to the succeeding lug so that the second side edge of the neighbor stator segment engages the first side edge of the anti-rotation stator segment.

DETAILED DESCRIPTION

Figure 1:
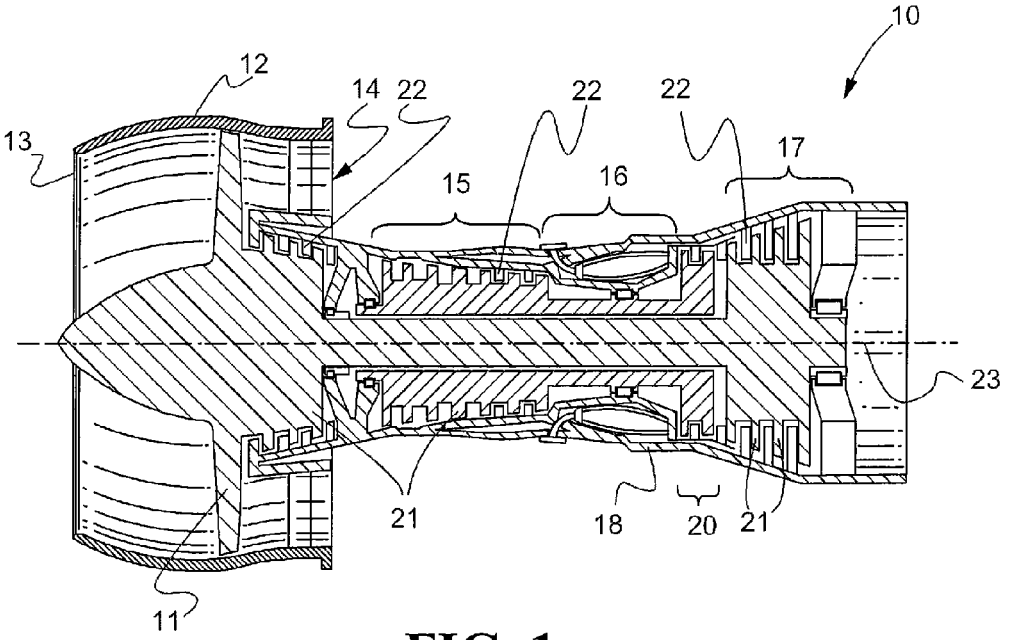
FIG. 1 is a schematic longitudinal sectional view of an exemplary turbofan gas turbine engine that may be equipped with the stator assembly disclosed herein.

Referring to FIG. 1, an exemplary turbofan gas turbine engine 10 is shown schematically. The gas turbine engine 10 includes a fan 11 disposed within an outer housing or shroud 12, which is only partially shown in FIG. 1. The fan 11 compresses intake air that enters through the housing opening 13 and feeds the compressed air to a low pressure compressor (LPC) 14. The LPC 14 is disposed between the fan 11 and a high pressure compressor (HPC) 15. The HPC 15 is disposed between the LPC 14 and a combustor 16. In the combustor 16, the air, which has been compressed by the LPC 14 and HPC 15, is mixed with fuel and ignited to generate a high energy and high velocity stream of gases that flows through a high pressure turbine (HPT) 20 before flowing through a low pressure turbine (LPT) 17. Energy from the stream of gases passing through the turbines 17, 20 is used to drive the LPC 14 and HPC 15 respectively. The LPC 14, HPC 15, combustor 16 HPT 20 and LPT 17 are housed within an inner shroud 18.

The LPC 14, HPC 15, HPT 20 and LPT 17 each include a plurality of rotors, shown generally at 21, that rotate between stationary stators, shown generally at 22. The dynamic loading of each stator 22 caused by the rotors 21 can generate tangential forces or circumferential forces about the central axis 23 of the engine 10 that can approach 500 lb·f (2225 N).

Figure 2:
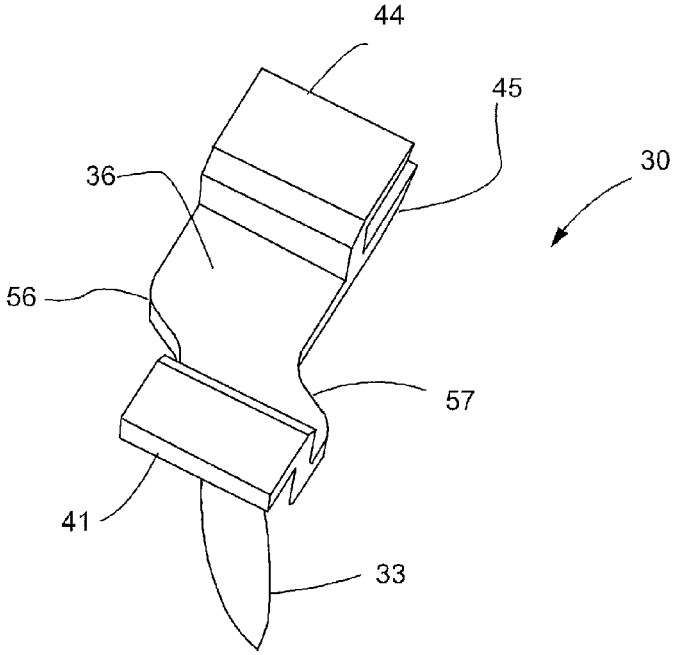
FIG. 2 is a top perspective view of a middle stator segment of the disclosed stator assembly.
Figure 3:
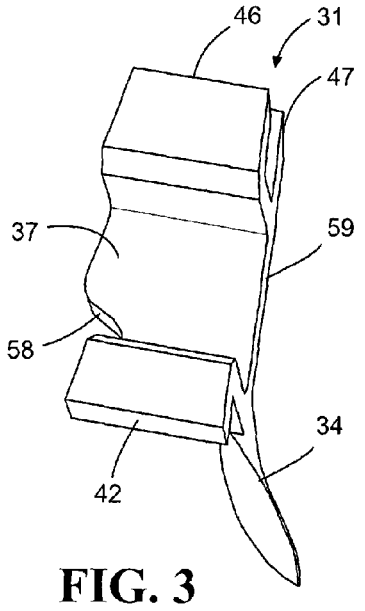
FIG. 3 is a top perspective view of a "neighbor" stator segment of the disclosed stator assembly.
Figure 4:
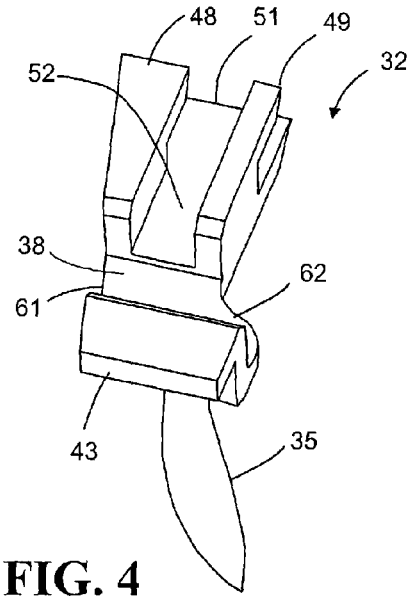
FIG. 4 is a top perspective view of an anti-rotation stator segment of the disclosed stator assembly.
Figure 6:
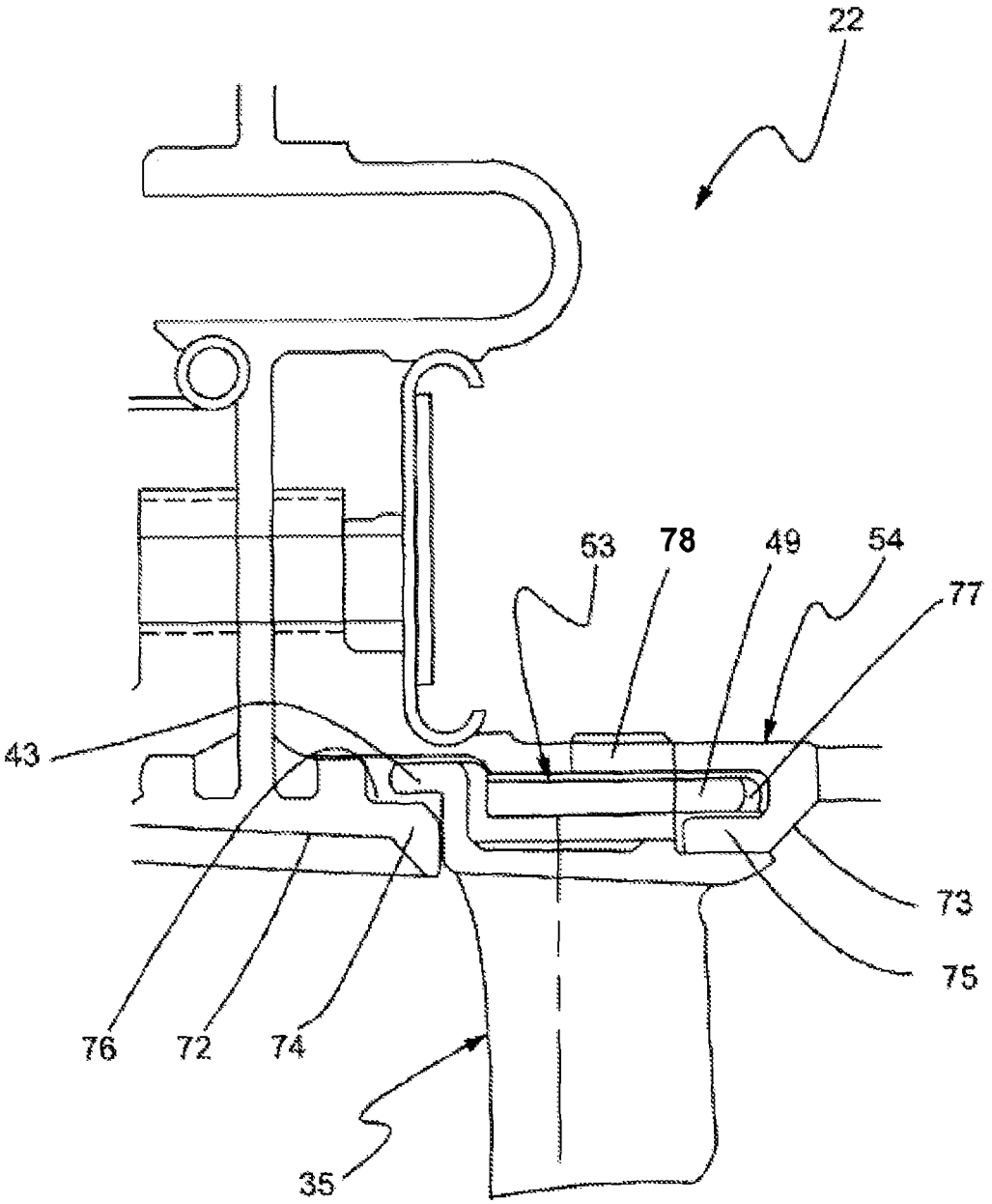
FIG. 6 is a partial sectional view of a turbofan gas turbine engine, particularly illustrating an anti-rotation stator segment coupled to an endless case.

Each stator assembly 22 may include three types of stator segments including a "middle" stator segment 30 as shown in FIG. 2, a "neighbor" stator segment 31 as shown in FIG. 3 and an anti-rotation stator segment 32 as shown in FIG. 4. Referring to FIGS. 2, 3 and 4 together, the stator segments 30, 31, 32 each include a radially inwardly extending vane 33, 34, 35. Each vane 33, 34, 35 extends downward from a shroud 36, 37, 38. Each shroud 36, 37, 38 is connected to a forward hook 41, 42, 43. Referring to FIGS. 2 and 3, each shroud 36, 37 may also be connected to a pair of aft hooks such as the upper aft hook 44 and lower aft hook 45 shown in FIG. 2 and the upper aft hook 46 and lower aft hook 47 shown in FIG. 3. For the anti-rotation stator segment 32 of FIG. 4, the shroud 38 may be coupled to a pair of upper aft hooks 48, 49 and a single lower aft hook 51 with a slot 52 extending between the upper aft hooks 48, 49. The slot 52 accommodates a lug 53 which is secured to the case 54 as shown in FIG. 6 and prevents the circumferential rotation of the stator segments about the endless case 54.

Returning to FIGS. 2-4, each stator segment 30, 31, 32 includes an opposing pair of side edges. Specifically, the stator segment 30 includes side edges 56, 57 that may be curved or non-linear. In the example shown in FIG. 2, the side edge 56 curves inwardly towards the vane 33 while the side edge 57 curves outwardly as shown. In FIG. 3, the side edge 58 curves inwardly towards the vane 34, yet the side edge 59 is straight or linear, all be it at an angle. Finally, turning to FIG. 4, the anti-rotation stator segment includes a straight or linear side edge 61 and a curved or non-linear side edge 62.

Figure 5:
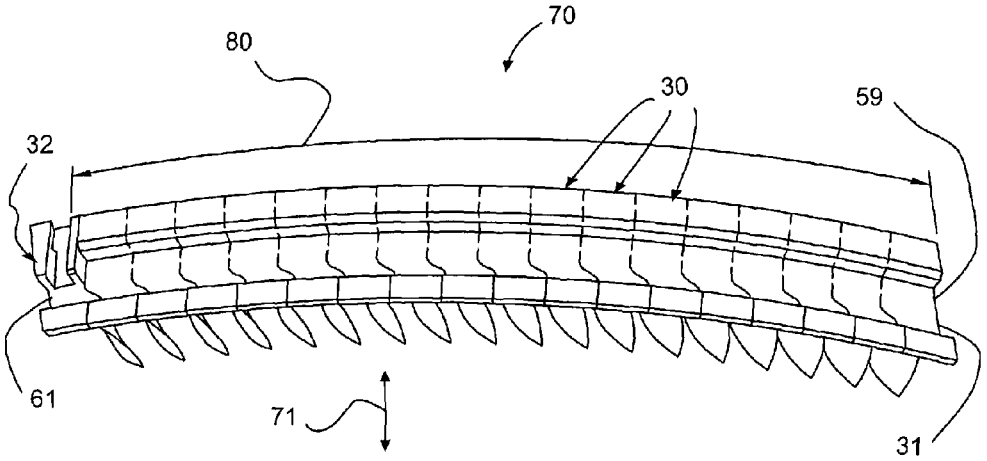
FIG. 5 is a stator segment cluster with an anti-rotation stator segment disposed at one end, a neighbor stator segment disposed at the other end and a plurality of middle stator segments disposed therebetween.

Turning to FIG. 5, a stator segment cluster 70 is disclosed with a locking stator segment 32 disposed at one end and a neighbor stator segment 31 disposed at the other end with a plurality of middle stator segments 30 disposed therebetween. The curved side edges 56, 57 of the middle stator segments 30 provide axial stability for the stator segments or prevent shifting in either axial direction as indicated by the double headed arrow 71.

However, when installing the stator segments 30, 31, 32 in an endless case 54 the last segment installed to complete an endless ring of stator segments 30, 31, 32 cannot be inserted in an axial direction as indicated by the arrow 71 but, instead, must be inserted from a radial direction which is problematic, if not impossible because of the case design. To solve this problem while still enabling the middle stator segments 30 to have curved side edges 56, 57, the side edges 59, 61 of the neighbor stator segment 31 and anti-rotation stator segment 32 are straight or linear, although angled. By providing the straight or linear side edges 59, 61 in addition to the curved side edges 56, 57, 58, 59, 62, the stator segments 30, 31, 32 will resist movement in either axial direction 71 and can also be assembled in an endless case with all segments being inserted axially, as opposed to radially. Further, the planar side edges 59, 61 facilitate a simplified machining of the stator segment cluster 70 to a specific arcuate length 80. An accurate machining of s-shaped or chevron-shaped side edges is inherently more difficult and therefore is more costly.

Turning to FIG. 6, the endless case 54 as shown with a central portion 78, a forward portion 72 and an aft portion 73. The forward portion 72 includes a rearwardly extending tab 74 and the aft portion 73 includes a forwardly extending tab 75. The central portion 78 and rearwardly extending tab portion 74 form a forward pocket 76 that receives the forward hook 43 of the anti-rotation stator 30. Further, the forwardly extending tab 75 and the central portion 78 form an aft pocket 77 that receives the aft hooks 48, 49 (see also FIG. 4).

INDUSTRIAL APPLICABILITY

Thus, a stator assembly is disclosed that includes an endless case coupled to the outer shroud of a gas turbine engine. The endless case accommodates a plurality of stator segments or a plurality of stator segment clusters. Stator segments include three types. An anti-rotation stator segment that engages a lug coupled to the endless case that prevents circumferential movement of the stator segments about the endless case. The second type of stator segment includes the "neighbor" stator segments which may be inserted into the case axially between a previously installed anti-rotation stator segment and a middle stator segment. The third type of stator segments includes the middle stator segments.

The middle stator segments include shrouds with curved side edges that prevent axial movement of the stator segments when a load is imposed on the vanes. To facilitate assembly of the stator segments in the endless case or to enable each stator segment to be placed in the case from an axial direction as opposed to a radial direction, the anti-rotation stator segment includes one linear or straight side edge, although it may be angled. The "neighbor" stator segment is placed between the anti-rotation stator segment and a previously installed middle stator segment. The neighbor stator segment also has a linear or straight side edge that is angled and that abuttingly engages the linear edge of the anti-rotation segment.

Although the side edges of the middle stator segments and the curved side edges of the neighbor and anti-rotation stator segments have an S-shaped profile, other geometries and designs that will prevent axial movement of the stator segments within the case will be apparent to those skilled in the art.

What is claimed is:

1. A stator assembly comprising:

an endless case coupled to a lug and defining an axis, the case coupled to a plurality of stator segments for forming an endless ring of stator segments, each stator segment including a shroud coupled to the case and a radially inwardly extending vane, the shroud of each stator segment including first and second opposing side edges, each of which engages an adjacent stator segment;

the plurality of stator segments includes an anti-rotation stator segment that is coupled to the lug, a neighbor stator segment disposed adjacent to the anti-rotation stator segment and a plurality of middle stator segments;

the shroud of the anti-rotation stator segment is coupled to a pair of upper aft hooks and a single lower aft hook extending in a facing spaced relationship with respect to the pair of upper aft hooks, the shroud of the anti-rotation stator segment including a slot extending from a first end located at a distal end of the single lower aft hook and between the pair of upper aft hooks and to a second end located past the pair of upper aft hooks and proximate to a forward hook of the anti-rotation stator segment and wherein the slot is configured to accommodate the lug therein;

the first side edges of the middle stator segments being non-linear and the second side edges of the middle stator segments being non-linear but shaped for abuttingly engaging the first opposing side edge of an adjacent middle stator segment;

the first side edge of the anti-rotation stator segment being linear, the second side edge of the neighbor stator segment being linear for abuttingly engaging the first side edge of the anti-rotation stator segment;

the second side edge of the anti-rotation stator segment being non-linear and shaped to abuttingly engage the first side edge of an adjacent middle stator segment, the first side edge of the neighbor stator segment being non-linear and shaped to abuttingly engage the second side edge of an adjacent middle stator segment;

the plurality of stator segments forming a plurality of stator segment clusters, each stator segment cluster including an anti-rotation stator segment, a neighbor stator segment and a plurality of middle stator segments disposed therebetween.

2. The stator assembly of claim 1 wherein the second side edge of the anti-rotation stator segment abuttingly engaging the first side edge of the adjacent middle stator segment of its respective stator segment cluster and the first side edge of the anti-rotation stator segment engaging the second side edge of the neighbor stator segment of an adjacent stator segment cluster.

3. The stator assembly of claim 1 further including a plurality of lugs, a plurality of anti-rotation stator segments and a plurality of neighbor stator segments.

4. The stator assembly of claim 1 wherein the first side edges of the middle stator segments and the neighbor stator segment curve inwardly into its respective shroud and the second side edges of the middle stator segments curve outwardly away from its respective shroud.

5. The stator assembly of claim 1 wherein the case includes a central portion and forward and aft portions that extend towards each other and form forward and aft pockets respectively beneath the central portion, the stator segments each including a forward hook and an aft hook, the forward and aft hooks being retained in the forward and aft pockets respectively.

6. The stator assembly of claim 1 wherein the slot in the shroud of the anti-rotation stator segment is at least substantially parallel to the axis of the case.

7. The stator assembly of claim 5 wherein the shroud of the anti-rotation stator segment includes the slot that accommodates the lug, the pair of aft hooks of the anti-rotation stator segment being disposed on either side of the slot, each aft hook including a fork with an upper leg received in the aft pocket and a lower leg disposed opposite the aft portion of the case from the aft pocket.

8. The stator assembly of claim 1 further comprising from 1 to 8 anti-rotation stator segments and lugs, each anti-rotation stator segment includes a slot that accommodates one of the lugs, each lug being fixedly coupled to the case.

9. A gas turbine engine comprising:

an outer shroud;

a stator assembly coupled to the outer shroud, the stator assembly including an endless case coupled to a lug and defining an axis, the case coupled to a plurality of stator segments for forming an endless ring of stator segments, each stator segment including a shroud coupled to the case and a radially inwardly extending vane, the shroud of each stator segment including first and second opposing side edges, each of which engages an adjacent stator segment;

the plurality of stator segments includes an anti-rotation stator segment that is coupled to the lug, a neighbor stator segment disposed adjacent to the anti-rotation stator segment and a plurality of middle stator segments;

the shroud of the anti-rotation stator segment is coupled to a pair of upper aft hooks and a single lower aft hook extending in a facing spaced relationship with respect to the pair of upper aft hooks, the shroud of the anti-rotation stator segment including a slot extending from a first end located at a distal end of the single lower aft hook and between the pair of upper aft hooks and to a second end located past the pair of upper aft hooks and proximate to a forward hook of the anti-rotation stator segment and wherein the slot is configured to accommodate the lug therein;

the first side edges of the middle stator segments being non-linear and the second side edges of the middle stator segments being non-linear but shaped for abuttingly engaging the first side edge of an adjacent middle stator segment;

the first side edge of the anti-rotation stator segment being linear, the second side edge of the neighbor stator segment being linear for abuttingly engaging the first side edge of the anti-rotation stator segment;

the second side edge of the anti-rotation stator segment being non-linear and shaped to abuttingly engage the first side edge of an adjacent middle stator segment, the first side edge of the neighbor stator segment being non-linear and shaped to abuttingly engage the second side edge of an adjacent middle stator segment;

the plurality of stator segments forming a plurality of stator segment clusters, each stator segment cluster including an anti-rotation stator segment, a neighbor stator segment and a plurality of middle stator segments disposed therebetween.

10. The engine of claim 9 wherein the second side edge of the anti-rotation stator segment abuttingly engaging the first side edge of the adjacent middle stator segment of its respective stator segment cluster and the first side edge of the anti-rotation stator segment engaging the second side edge of the neighbor stator segment of an adjacent stator segment cluster.

11. The engine of claim 9 wherein the first side edges of the middle stator segments and the neighbor stator segment curve inwardly into its respective shroud and the second side edges of the middle stator segments curve outwardly away from its respective shroud.

12. The engine of claim 9 wherein the case includes a central portion and forward and aft portions that extend towards each other and form forward and aft pockets respectively beneath the central portion;

the stator segments each including a forward hook and an aft hook, the forward and aft hooks being retained in the forward and aft pockets respectively.

13. The engine of claim 9 wherein the slot in the shroud of the anti-rotation stator segment is at least substantially parallel to the axis of the case.

14. The engine of claim 12 wherein the shroud of the anti-rotation stator segment includes the slot that accommodates the lug, the pair of aft hooks of the anti-rotation stator segment being disposed on either side of the slot, each aft hook including a fork with an upper leg received in the aft pocket and a lower leg disposed opposite the aft portion of the case from the aft pocket.

15. The engine of claim 9 further comprising from 1 to 8 anti-rotation stator segments and lugs, each anti-rotation stator segment includes a slot that accommodates one of the lugs, each lug being fixedly coupled to the case.

16. A method for forming a stator stage of a gas turbine engine, the method comprising:

providing an endless case coupled to a plurality of lugs and defining an axis, the case including a forward portion and an aft portion that extend towards each other to form forward and aft pockets respectively;

coupling the one of the forward or aft portions to an outer shroud of the engine; providing a plurality of stator segment clusters, each stator segment cluster including an anti-rotation stator segment, a neighbor stator segment and a plurality of middle stator segments disposed therebetween, each anti-rotation stator segment, neighbor stator segment and middle stator segment including a shroud and a radially inwardly extending vane, the shroud of each anti-rotation, neighbor and middle stator segment including first and second opposing side edges for engaging an adjacent stator segment, the first side edges of the middle stator segments being non-linear and the second side edges of the middle stator segments being non-linear but shaped for abuttingly engaging the first opposing side edge of an adjacent middle stator segment, the first side edges of the anti-rotation stator segments being linear, the second side edges of the neighbor stator segments being linear for abuttingly engaging the first side edge of one of the anti-rotation stator segments, the second side edges of the anti-rotation stator segments being non-linear and shaped to abuttingly engage the first side edge of an adjacent middle stator segment, the first side edge of the neighbor stator segment being non-linear and shaped to abuttingly engage the second side edge of an adjacent middle stator segment;

axially inserting the anti-rotation stator segment of one cluster into the case at one of the lugs to couple the anti-rotation stator segment to the lug, the shroud of the anti-rotation stator segment being coupled to a pair of upper aft hooks and a single lower aft hook extending in a facing spaced relationship with respect to the pair of upper aft hooks, the shroud of the anti-rotation stator segment including a slot extending from a first end located at a distal end of the single lower aft hook and between the pair of upper aft hooks and to a second end located past the pair of upper aft hooks and proximate to a forward hook of the anti-rotation stator segment and the slot being configured to accommodate the lug therein;

axially placing a middle stator segment next to the anti-rotation stator segment so the first side edge of the middle stator segment abuttingly engages the second side edge of the anti-rotation stator segment;

repeatedly and axially placing middle stator segments into the case so the first side edge of a succeeding middle stator segment engages the second side edge of a preceding middle stator segment until a gap exists between a succeeding middle stator segment a succeeding lug;

axially inserting the neighbor stator segment into the gap;

axially inserting another anti-rotation stator segment into the case to couple said another anti-rotation stator segment to the succeeding lug and so the second side edge of the neighbor stator segment engages the first side edge of said another anti-rotation stator segment.

17. The method of claim 16 wherein the case includes from 1 to 8 anti-rotation stator segments and lugs, each lug being fixedly coupled to the case.

18. The method of claim 16 wherein the case includes a central portion and the forward and aft portions that extend towards each other and form forward and aft pockets respectively beneath the central portion;

the stator segments each including a forward hook and an aft hook, the forward and aft hooks being retained in the forward and aft pockets respectively.

* * * * *